United States Patent [19]

Hirai et al.

[11] 4,281,232

[45] Jul. 28, 1981

[54] SMALL ILLUMINATING SWITCH

[75] Inventors: Akira Hirai; Yukihisa Tanaka; Shigeo Ohashi, all of Tokyo, Japan

[73] Assignee: Nihon Kaiheiki Kogyo Kabushiki Kaisha, Tokyo, Japan

[21] Appl. No.: 128,618

[22] Filed: Mar. 10, 1980

[51] Int. Cl.[3] ..... H01H 9/16

[52] U.S. Cl. ..... 200/315; 200/153 H

[58] Field of Search ..... 200/315, 153 H, 153 G

[56] References Cited

U.S. PATENT DOCUMENTS

| | | | |
|---|---|---|---|
| 3,301,988 | 1/1967 | Weitzman | 200/315 |
| 4,013,857 | 3/1977 | Tanaka | 200/315 |
| 4,024,367 | 5/1977 | Kodaira et al. | 200/315 |
| 4,055,739 | 10/1977 | Piber | 200/315 |
| 4,172,973 | 10/1979 | Sano | 200/315 |

FOREIGN PATENT DOCUMENTS

| | | | |
|---|---|---|---|
| 2447378 | 4/1976 | Fed. Rep. of Germany | 200/315 |
| 2556461 | 6/1977 | Fed. Rep. of Germany | 200/315 |
| 2223806 | 3/1973 | France | 200/315 |

*Primary Examiner*—Willis Little

*Attorney, Agent, or Firm*—Lawrence I. Field

[57] ABSTRACT

The improved small switch of this invention comprises: a housing having at least one open end; main contact contained in the housing and having at least one first movable contact element and at least one first fixed contact element; a cover member mounted on the open end of the housing; a movable operating handle whose one end is disposed within the housing and the other end extends through and projects from the cover member; an illuminator disposed at one end of the movable operating handle; a converter member disposed at the other end of the movable operating handle for making or breaking the main contact; second movable contact elements fitted to the converter member; lead wires disposed within the interior space of the movable operating handle and connecting the second movable contact elements and the illuminator; and second fixed contact elements disposed within the housing, with which the second movable contact elements are brought into contact. This switch also includes an insulating member contained in the hollow interior space of the movable operating handle and having at least two through bores into which the terminals of the illuminator and the bare end portions of the lead wires are inserted so as to make firm contact with each other.

10 Claims, 17 Drawing Figures

SMALL ILLUMINATING SWITCH

BACKGROUND OF THE INVENTION

This invention relates to an improved small switch. More particularly, it relates to an improved switch used as a toggle switch or wave type switch for making or breaking the main contacts by manipulating a movable operating handle; in which lead wires from an illuminator mounted at one end of the movable operating handle are safely conducted to the contact elements of the main contact converter member in such a manner that the lead wires do not move relative to the handle; in which the contact elements to which the lead wires are connected at one end can be readily and reliably fitted to the converter member; and in which the terminals of the illuminator and the ends of the lead wires can be easily connected in the movable operating handle.

In the conventional small illuminating switch of this type, the lead wires from the illuminator are drawn out into the interior space of the switch body through an opening formed in the movable handle connected with the converter member or slider member, and then are connected to the terminals of the lighting circuit. In this construction, a trouble often results in the electric circuit from the illuminator, such as a lamp or light-emitting diode fitted at the top end of the handle, to the terminals of the lighting circuit fitted in the switch body. Especially, the lead wires drawn out from the illuminator are forced to move relative to the handle every time the handle is operated so that the lead wires become fragile by the bending motion and may be broken. Furthermore, the connecting portion between the terminals of the lighting circuit and the lead wires drawn out through the opening may be damaged as a result of the repeated operation of the handle.

In a case where the lead wires connected to the illuminator at the top end of the movable operating handle are drawn out through an opening formed in the handle at a location reasonably spaced from the fulcrum of the handle and are then connected to the contact elements fitted in the housing of the switch, the following drawback is observed. That is, since the lead wires are oscillated each time the handle is operated, the lead wires must be loose to provide a play for oscillatory movement so that the loose wires are often caught by the internal mechanism of the switch such as the movable contact elements, causing malfunctions or improper connection between the contacts.

SUMMARY OF THE INVENTION

To sum up, this invention provides an improved small switch.

The switch of this invention comprises: a housing having at least one open end; main contact contained in the housing and having at least one first movable contact element and at least one first fixed contact element; a cover member mounted on the open end of the housing; a movable operating handle whose one end is disposed within the housing and the other end extends through and projects from the cover member; an illuminator disposed at one end of the movable operating handle; a converter member disposed at the other end of the movable operating handle for making or breaking the main contacts; second movable contact elements fitted to the converter member; lead wires disposed within the interior space of the movable operating handle and connecting the second movable contact elements and the illuminator; and second fixed contact elements disposed within the housing with which the second movable contact elements are brought into contact.

This switch also includes an insulating member contained in the hollow interior space of the movable operating handle and having at least two through bores into which the terminals of the illuminator and the bare end portions of the lead wires are inserted so as to make firm contact with each other.

The converter member is formed with first bores having a step into which the second movable contact elements are fitted.

Thus, an object of this invention is to provide an improved small illuminating switch.

Another object of this invention is to provide an improved small illuminating switch in which the lead wires connected to the illuminator mounted on one end of the movable operating handle is safely conducted to the converter member secured to the other end of the handle in such a manner that the lead wires do not move relative to the handle when the handle is operated, the converter member being adapted to open or close the main contacts.

Still another object of this invention is to provide an improved small illuminating switch in which the contact elements, to which the lead wires disposed within the interior space of the movable operating handle are connected at one end, can be readily and reliable fitted to the converter member secured to one end of the handle.

A further object of this invention is to provide an improved small illuminating switch in which the terminals of the illuminator and the ends of the lead wires can be readily connected in the movable operating handle.

Other objects and advantages of this invention will become apparent from the following description.

This invention therefore covers those features in construction and those combinations and arrangements of members and parts that are detailed in the following in conjunction with the preferred embodiments, and the scope of this invention is specified in the claims.

BRIEF DESCRIPTION OF THE DRAWINGS

For thorough understanding of this invention, the attached drawings should be referred to, in which.

DESCRIPTION OF THE PREFERRED EMBODIMENT

Figure 1:
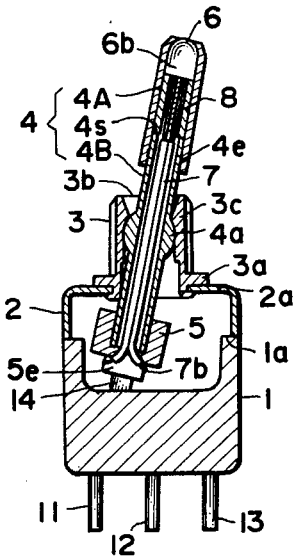
FIG. 1 is a schematic cross-sectional view of the small illuminating switch constructed according to this invention.
Figure 3A:
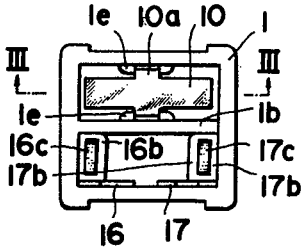
FIG. 3*a* is a plan view showing the interior of the switch body of the illuminating switch of this invention.
Figure 3B:
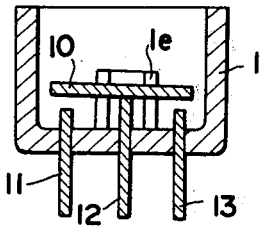
FIG. 3*b* is a cross-sectional view taken along the line III—III of FIG. 3*a;*
Figure 2:
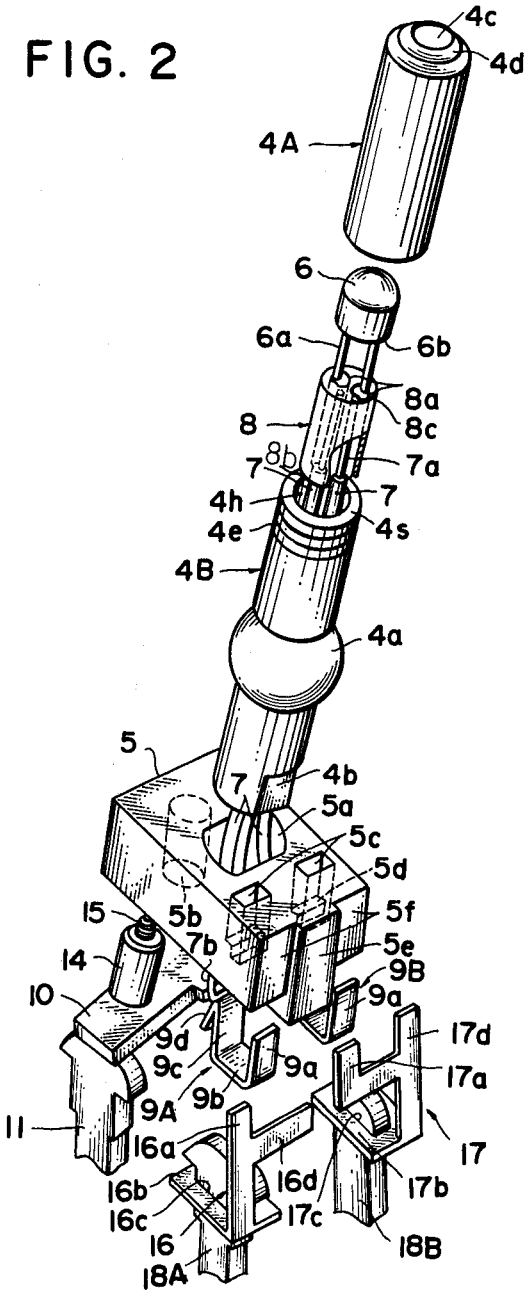
FIG. 2 is a perspective view of the main portion of the illuminating switch of this invention.

FIG. 1 is a schematic cross-sectional view of the switch of this invention, and FIG. 2 is a perspective view of the switch with main parts disassembled. In these figures, reference numeral 1 represents a housing for containing a switch body, the housing having an open end 1*a* and a central partition wall 1*b* of a predetermined height (as shown in FIG. 3*a*). The housing 1 is provided at its open end 1*a* with a cover 2 and a sleeve 3, the cover and the sleeve forming a cover member. In other words, the cover 2 is secured to the open end 1*a* of the housing 1 by a suitable means, and the sleeve 3 is fastened to the upper surface 2*a* of the cover 2 by an external screw 3*a* fitted to the lower end portion of the sleeve 3. Provided in the housing 1 and projecting from the upper end 3*b* of the sleeve 3 is a movable operating handle 4 which is a cylindrical member with a hollow interior space 4*h* and whose upper cylindrical member 4A and lower cylindrical member 4B are detachably connected by a threaded portion 4*e*. As shown in FIG. 1, a swivel portion 4*a* formed on the almost central portion of the lower cylindrical member 4B is supported in a swivel receiver 3*c* formed on the upper inner wall of the sleeve 3 and is biased by a coiled spring 15 (shown in FIG. 2) so that the handle 4 can be tilted to the right and left about the swivel receiver 3*c* as a fulcrum.

Figure 4A:
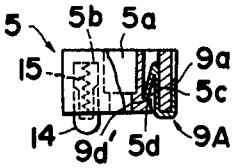
FIG. 4*a* is a cutaway view showing the converter member of the illuminating switch of this invention.

Secured to the lower portion of the movable operating handle 4 is a converter 5 which has a through opening 5*a* at its center and a bore 5*b* cut into the lower surface. The converter 5 also has a pair of bores 5*c*, 5*c* extending therethrough, which are each provided with a upwardly inclined step 5*d*. The side surface of the converter 5 adjacent to the pair of bores 5*c* is formed with a slightly raised central surface 5*e* and two slightly recessed surfaces 5*f* on both side thereof. A cut portion 4*b* formed at the lower end of the handle 4 is loosely inserted into the through opening 5*a* at the center of the converter so that the converter 5 can be oscillated to the right and left by mannually tilting the handle 4 toward the right and left, as viewed in FIG. 1. As shown in FIG. 4*a*, a telescopic slider 14 is inserted into the bore 5*b* cut into the underside of the converter 5 with the coiled spring 15 interposed between the slider and the bottom of the bore so that the telescopic slider 14 projects out of the lower surface of the converter 5. The telescopic slider 14 is biased by the spring 15 to bear against a movable contact element 10 so as to make or break the main contacts which are provided in one half of the housing 1 divided by the central partition wall 1*b*. A pair of ears 10*a* of the movable contact element 10 which constitutes part of the main contacts are supported by a pair of support walls 1*e* projecting within the housing 1, with the central undersurface of the movable contact element resting on a terminal 12 extending through the bottom wall of the housing 1. The movable contact element 10 is so supported that it can be tilted about the terminal 12 as the fulcrum in either direction to make selective contact with fixed contact elements or terminals 11 and 13, these fixed contacts extending through the bottom wall of the housing 1 like the terminal 12. The telescopic slider 14 is urged by the coiled spring 15 to bear against the upper surface of the movable contact element 10, as shown in FIG. 2. The upward reactionary force of the spring 15 presses, through the converter 5, the swivel portion 4*a* of the handle 4 into the swivel receiver 3*c* formed on the inner wall of the sleeve 3. Disposed within the interior space of the upper end of the upper cylindrical member 4A is an illuminator 6 such as a lamp and a light-emitting diode, which has two pin-like terminals 6*a* projecting downwardly from the undersurface thereof. The illuminator 6 emits light upwardly through the upper end surface 4*c* of the upper cylindrical member 4A of the handle 4. The upper cylindrical member 4A has a small-diameter portion 4*d* around the upper end surface 4*c* for preventing the illuminator 6 from getting out of the upper cylindrical member 4A. Two lead wires 7 which electrically connect the terminals 6*a* of the illuminator 6 with lower terminals 18A, 18B extend downward through the entire length of the lower cylindrical member 4B of the handle and into the converter 5.

To facilitate the connection between the terminals 6*a* of the illuminator 6 and the upper ends of the lead wires 7, a cylindrical insulating member 8 is inserted, next to the illuminator 6, into the upper cylindrical member 4A. The insulating member 8 is made of insulating material such as synthetic resin with elasticity and has a pair of through bores 8*a* extending longitudinally therethrough. As shown in FIG. 2, the pair of terminals 6*a* of the illuminator 6 are inserted into the pair of through bores 8*a* from above and the bare end portions 7*a* of the pair of lead wires 7 are inserted into it from below. Thus, the terminals 6*a* and the bare end portions 7*a* are arranged side by side contacting each other in the through bores 8*a*. By properly selecting the diameters of the through bores 8*a*, it is possible to cause the terminals and the conductors to press against each other with the aid of the proper elasticity of the insulating member 8, so that good electrical and mechanical connection can be obtained by simply inserting the lead wires and the terminals into the through bores 8*a* formed through the insulating member 8. The lower end 8*b* of the insulating member 8 abuts against the upper end 4*s* of the lower cylindrical member 4B of the handle, and the upper end 8*c* of the insulating member 8 against the lower end 6*b* of the illuminator 6. In this condition, the upper cylindrical member 4A of the handle 4 is screwed over the threaded portion 4*e* formed on the outer surface of the upper portion of the lower cylindrical member 4*b* thereby firmly securing the upper and lower cylindrical members together and holding the insulating member 8 and the illuminator 6 in place in the upper cylindrical member 4A.

Figure 5A:
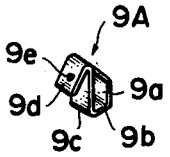
FIG. 5*a* is a perspective view showing the contact element of the illuminating switch of this invention.

Denoted by 9A, 9B are a pair of contact elements resiliently fitted to the converter 5 for receiving the uncovered lower end portions 7*b* of the pair of lead wires 7 and securing them to the converter 5. As shown in FIGS. 2 and 5*a*, each of the contact elements 9A, 9B has a U-shaped portion 9*a*-9*b*-9*c* and an elastic tongue 9*d* downwardly bending from one of the upper ends of the U-shaped portion. The tongue 9*d* is formed with an opening 9*e* through which the lower end bare portion 7*b* of the lead wire 7 is inserted to be connected therewith. The lower end bare portion 7*b* of the lead wire 7 may be wound on any of the portions 9*a*, 9*b*, 9*c*, 9*d*, instead of being inserted through the opening 9*e*. In this case, the opening 9*e* may be omitted. The contact elements 9A, 9B are fitted to the converter 5 by inserting the bent portions 9*c*-9*d* into the bore 5*c* from below, as shown in FIG. 4*a*. The tongue 9*d* has sufficient elasticity so that it is deformed when being inserted since the lower portion of the bore 5*c* is narrow but, when the lower end 9*d*' of the tongue 9*d* is pushed above the step 5*d*, the tongue 9*d* snaps back and expands as shown in FIG. 4*a*, with the lower end 9*d*' abutting against the step 5*d*, thereby preventing the contact elements 9A, 9B from coming off the converter 5. Then the portion 9*a* of each contact element contacts the recessed surface 5*f* on each side of the raised surface 5*e* of the converter 5. Thus, the contact elements can be fitted to the converter very easily simply by inserting them into the bores. The lower end bare portions 7*b* of the lead wires 7 extend downward through the opening 5*a* formed in the converter 5 and are connected, for example, to the tongue 9*d* as described earlier.

Corresponding to the pair of movable contact elements 9A, 9B, a pair of fixed contact elements 16, 17 are provided to the inner wall of the housing 1. As shown in FIGS. 2 and 3*a*, the fixed contact element 16 consists of a vertical portion 16*a*, a horizontal portion 16*b*, a rectangular hole 16*c* and a horizontally extended portion 16*d* while the other fixed contact element 17 consists of a vertical portion 17*a*, a horizontal portion 17*b*, a rectangular hole 17*c* and a vertically extended portion 17*d*. The vertical portion 16*a* of the contact element 16 corresponds to the contact element 9A on the left-hand side, as viewed in FIG. 2, and the vertical portion 17*a* of the contact element 17 to the contact element 9B on the right-hand side. As already mentioned, the contact element 16 has a rectangular hole 16*c* formed in the horizontal portion 16*b* extending from a lower end of the vertical portion 16*a* at a right angle thereto. A terminal 18A similar in shape to the fixed contact elements or terminals 11, 13 is inserted into the rectangular hole 16*c* from above and is also inserted through the bottom wall of the housing 1 so as to be fixed in it. Likewise, the contact element 17 has a rectangular hole 17*c* formed in the horizontal portion 17*b* and a terminal 18B extends through the rectangular hole 17*c* and through the bottom wall of the housing 1 so that the terminal 18B is secured to the housing. The horizontally extended portion 16*d* of the contact element 16 and the vertically extended portion 17*d* of the contact element 17 are provided for giving the switch multiple purposes, and may be omitted.

When the handle 4 is in a position shown in FIG. 1, the portion 9*a* of the movable contact element 9A makes contact with the vertical portion 16*a* of the fixed contact element 16, and the other movable contact element 9B with the vertical portion 17*a* of the fixed contact element 17 so that the illuminator 6 is electrically connected to the fixed contact elements 16, 17. When the handle 4 is pressed to the opposite side, the portion 9*a* of the contact element 9B makes contact with the vertically extended portion 17*d* of the fixed contact element 17 but the portion 9*a* of the contact element 9A disengages from the fixed contact element 16 so that the circuit of the illuminator 6 is open.

Figure 4B:
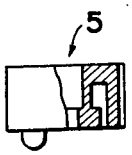
FIG. 4*b* is a cutaway view showing another example of the converter member constructed according to this invention.
Figure 4C:
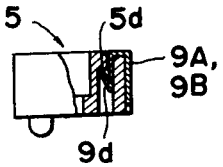
FIG. 4*c* is a cutaway view showing still another example of the converter member in the illuminating switch of this invention.

As a variation of the converter 5, the bores 5*c* may be formed such that they open downwardly only, with the upper end of the bores closed, as shown in FIG. 4*b*, in which case the movable contact elements 9A, 9B are inserted into the bores 5*c* from below. Conversely, it is also possible to insert the contact elements 9A, 9B into the converter 5 from above, as shown in FIG. 4*c*. In this case, the tongue 9*d* is upwardly inclined and the step 5*d* downwardly inclined.

Figure 5B:
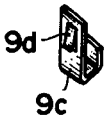
FIG. 5*b* is a perspective view showing another example of the contact element in the illuminating switch of this invention.

As a variation of the contact elements 9A, 9B, the central area of the portion 9*c* may be cut to form a rectangular elastic tongue 9*d* whose lower end is projected as shown in FIG. 5*b*, instead of providing the elastic tongue 9*d* separately from the portion 9*c*, as shown in FIG. 5*a*.

Figure 6A:
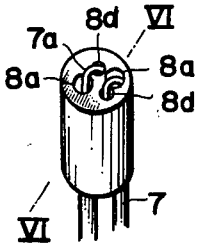
FIG. 6*a* is a perspective view showing an example of the insulating member in the illuminating switch of this invention.
Figure 6B:
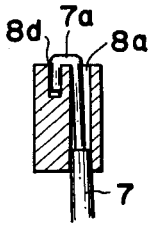
FIG. 6*b* is a cross-sectional view taken along the line VI—VI of FIG. 6*a*.
Figure 6C:
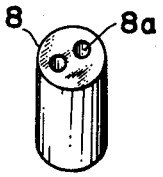
FIG. 6*c* is a perspective view showing another example of the insulating member in the illuminating switch of this invention.
Figure 6D:
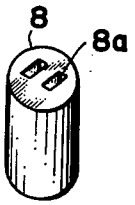
FIG. 6*d* is a perspective view showing still another example of the insulating member in the illuminating switch of this invention.
Figure 6E:
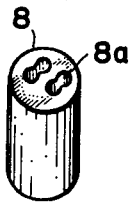
FIG. 6*e* is a perspective view showing a further example of the insulating member in the illuminating switch of this invention.

The pair of through bores 8*a* of the insulating member 8 may take various forms as shown in FIGS. 6*a* through 6*e*. Generally, the gourd-shaped bores are most desirable (FIG. 6*e*). They may be formed into circular bores (FIG. 6*c*) or rectangular bores (FIG. 6*d*). In the gourd-shaped bores, the two bores may be arranged so that the longitudinal center lines run parallel to each other, as shown in FIG. 6*e*, or they may be arranged in a line. Furthermore, a pair of small holes 8*d* may be formed in the insulating material 8, in addition to the pair of through bores 8*a*, as shown in FIGS. 6*a* and 6*b*. The small holes 8*d* are to secure to the insulating member 8 the bare end portions 7*a* of the lead wires 7, as shown in FIG. 6*b*, that are to be connected with the terminals 6*a* of the illuminator 6. The insulating member 8 may also be omitted and the handle 4 may be formed as a continuous single body.

Figure 7A:
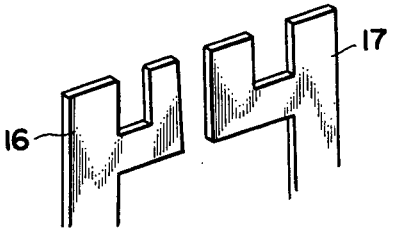
FIGS. 7*a* and 7*b* are perspective views showing other examples of the fixed contact elements in the illuminating switch of this invention.
Figure 7B:
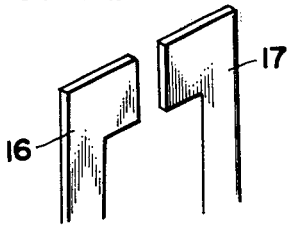

If the illuminator is turned on or off by changing over the power switch and therefore the on-off switching action is not required in the illuminator circuit, the fixed contact elements 16, 17 may be formed as shown in FIGS. 7*a* and 7*b*.

Figure 8:
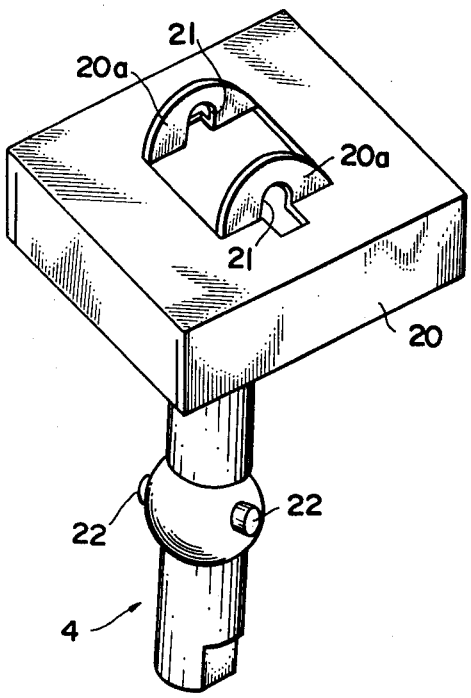
FIG. 8 is a disassembled perspective view showing another example of the supporting mechanism of the movable operating handle in the illuminating switch of this invention.

The supporting means for the movable operating handle 4 is not limited to the above embodiment. As shown in FIG. 8, a pair of pivotal shafts 22 provided to the movable operating handle 4 may be inserted into bearing holes 21 formed in a pair of erected walls 20*a* on the cover 20 and the handle 4 may be biased by the spring 15 fitted in the converter 5 so that the handle 4 can be pivoted about the supported pivotal shafts.

This invention is constructed and works as stated above. According to this invention, the lead wires for the illuminator mounted within the upper portion of the handle are conducted down through the handle into the main contact converter where they are connected with the movable contact elements fitted to the converter, so that the oscillatory movement of the handle does not produce relative movement of the lead wires with respect to the handle. This gives the following advantages: the lead wires can be prevented from being bent or damaged; the movable contact elements can easily be mounted to the converter; and the construction becomes relatively simple and the size small.

Furthermore, this invention has advantages that the connection or disconnection between the terminals of the illuminator and the lead wires can easily be done and that, when connected, they are pressed against each other by the elasticity of the insulating member, thus providing a firm connection between them.

Though preferred embodiments of this invention have been shown and described herein, it should be noted that these embodiments simply illustrate examples and that many changes and modifications may be made without departing from the spirit of the invention.

Likewise, the following claims that are intended to cover all the general and specific features of this invention must be construed without adhering too strictly to the forms and styles used therein.

What is claimed is:

1. An illumination-type small sized toggle lever switch comprising:

a housing having at least one open end;

main contact contained in the housing and having at least one first movable contact element and at least one first fixed contact element;

a cover member mounted on the open end of the housing said cover member including a cover mounted on the open end of the housing and a sleeve mounted on said cover;

a movable operating handle comprising a cylindrical member having a hollow interior space extending longitudinally therethrough, said movable operating handle having two open ends, one open end being disposed within said housing and the other open end projecting from said sleeve;

an illuminator having terminals and being disposed in said hollow interior space and at said open end of said movable operating handle projecting from said sleeve;

a convertor member disposed at the other end of the movable operating handle for making or breaking the main contacts;

second movable contact elements fitted to the convertor member;

lead wires having bare end portions and extending in said interior space of said movable operating handle therethrough for electrically connecting said illuminator to said second movable contact elements;

an insulating member being contained in said hollow interior space of said movable operating handle, said insulating member having at least two through bores through which said lead wires are led so as to be electrically connected with said illuminator;

said convertor member being formed with a through opening into which said open end of the movable operating handle is fitted, and said lead wires being passed through said opening so as to be connected with said second movable contact elements;

said movable operating handle consisting of a first cylindrical member and a second cylindrical member, said first cylindrical member containing said illuminator and said insulating member;

said movable operating handle having a swivel portion which is received by a swivel receiver formed on the inner wall of said sleeve so that the handle can be swiveled about the swivel receiver portion as a fulcrum; and second fixed contact elements disposed within the housing and which the second movable contact elements are brought into contact.

2. A small illuminating switch as set forth in claim 1, wherein said converter member is formed with first bores with a step, into which the second movable contact elements are fitted.

3. A small illuminating switch as set forth in claim 2, wherein said second movable contact elements each have an elastic tongue which abuts against the step formed in the first bores of the converter member.

4. A small illuminating switch as set forth in claim 2, wherein said converter member has a second bore cut into the surface thereof facing the first movable contact element, into which a telescopic slider is slidably fitted, with a coiled spring interposed between the slider and the bottom of the bore so that the telescopic slider projects from that surface and resiliently bears against the first movable contact element to make or break the main contacts.

5. A small illuminating switch as set forth in claim 4, wherein said first movable contact element is oscillatable.

6. A switch as set forth in claim 1, wherein said insulating member is made of elastic material, the terminals of the illuminator and the bare end portions of said lead wires being inserted into said through bores of said insulating member to make contact with each other.

7. A small illuminating switch as set forth in claim 6, wherein the cross section of the through bores of the insulating member is gourd-shaped.

8. A small illuminating switch as set forth in claim 6, wherein the cross section of the through bores of the insulating member is rectangular.

9. A small illuminating switch as set forth in claim 6, wherein the cross section of the through bores of the insulating member is circular.

10. A small illuminating switch as set forth in claim 6, wherein said insulating member has at least two small holes for securing the bare end portions of the lead wires thereto, said bare end portions being connected with the terminals of the illuminator.

* * * * *